US007240515B2

(12) United States Patent
Conry

(10) Patent No.: US 7,240,515 B2
(45) Date of Patent: Jul. 10, 2007

(54) CENTRIFUGAL COMPRESSOR

(75) Inventor: Ronald David Conry, Hudson (CA)

(73) Assignee: Turbocor, Inc., Dorval, Quebec (CA)

( * ) Notice: Subject to any disclaimer, the term of this patent is extended or adjusted under 35 U.S.C. 154(b) by 357 days.

(21) Appl. No.: 10/505,912

(22) PCT Filed: Feb. 28, 2003

(86) PCT No.: PCT/CA03/00285

§ 371 (c)(1),
(2), (4) Date: Aug. 26, 2004

(87) PCT Pub. No.: WO03/072946

PCT Pub. Date: Sep. 4, 2003

(65) Prior Publication Data

US 2005/0223737 A1 Oct. 13, 2005

(30) Foreign Application Priority Data

Feb. 28, 2002 (CA) ..... 2373905

(51) Int. Cl.
*F25B 1/10* (2006.01)

(52) U.S. Cl. ..... 62/510

(58) Field of Classification Search ..... 62/510; 415/179; 417/310

See application file for complete search history.

(56) References Cited

U.S. PATENT DOCUMENTS

| | | | | |
|---|---|---|---|---|
| 2,458,560 A | | 1/1949 | Buchanan | |
| 4,969,803 A | | 11/1990 | Turanskyj | |
| 5,110,264 A | | 5/1992 | Murry | |
| 5,157,924 A | * | 10/1992 | Sudmanns | 60/612 |
| 5,350,039 A | | 9/1994 | Voss | |
| 5,857,348 A | | 1/1999 | Conry | |
| 5,875,637 A | | 3/1999 | Paetow | |

FOREIGN PATENT DOCUMENTS

| | | |
|---|---|---|
| EP | 0 552 127 | 7/1993 |
| WO | WO94 05913 | 3/1994 |

* cited by examiner

*Primary Examiner*—Melvin Jones
(74) *Attorney, Agent, or Firm*—Schnader, Harrison Segal & Lewis, LLP

(57) ABSTRACT

A compact and efficient compressor is provided, based on using magnetic bearing technology, which can operate at high speed and comprises a reliable control system. The compressor of the present invention makes use of two separate compressors mounted on a single common motor, thus sharing a single drive. The balancing of the thrust at high RPM is improved by using a pair of electromagnetic bearings.

11 Claims, 5 Drawing Sheets

CENTRIFUGAL COMPRESSOR

FIELD OF THE INVENTION

The present invention relates to centrifugal compressors. More precisely, the present invention is concerned with a twin centrifugal compressor.

BACKGROUND OF THE INVENTION

Compressors are used in refrigeration systems, environment control systems, air conditioning systems and the like. For convenience, the invention will be described with particular reference to air conditioning systems. Air conditioning systems utilize compressors of varying sizes ranging from very small compressors used in motor vehicles and domestic situations to compressors of up to thousands of Tons capacity used in commercial air-conditioning equipment.

Refrigerants and air conditioning systems currently use a refrigerant R12 or a singular refrigerant that is a CFC or HCFC refrigerant, which is now known as potentially damaging to the environment, or R22, which is currently approved for use under the Montreal Protocol on the ozone layer until 2030 A.D for example. However, use of any refrigerant must be in progressively reduced volumes. A main CFC-free commercial refrigerant currently endorsed without reservation by the Montreal Protocol and by the International Heating, Ventilation and Air Conditioning Industry (HVAC) is the refrigerant known as R134A. This refrigerant, however, is commercially unsuitable as a direct replacement for the CFC refrigerants in existing hematic or semi-hematic machines because the chemical structure of R134A results in a performance loss of up to 30%. Furthermore, the refrigerant R134A is basically unsuitable for use with existing compressors without major mechanical changes because the refrigerant is chemically incompatible with lubricants now available for mechanical bearings and other rotating or reciprocating pans of the compressors.

Another difficulty with current air conditioning systems is that, traditionally, small to medium refrigeration systems of a capacity in the range between 1 and 150 kilowatts use reciprocating, rotary or scroll compressors, which are relatively cheap to produce but are also relatively inefficient. Screw compressors become more efficient at sizes between 50 and 300 Tons although most systems over 180 Tons use centrifugal compressors, since these are more efficient than screw compressors. However, centrifugal compressors, which, basically, comprise a rotor sending air radially outwards into a stator under centrifugal action to create compression, involve high rotational speeds and are generally far more costly to produce and maintain.

In summary, the efficiency of the smaller equipment below 180 Tons is restricted by the available technology in the reciprocating, rotary, scroll and screw compressors. While centrifugal machines can offer a higher efficiency in the lower capacity range, limitations on high rotational speed drives, and the cost thereof, inhibits their use.

OBJECTS OF THE INVENTION

An object of the present invention is therefore to provide an improved centrifugal compressor.

SUMMARY OF THE INVENTION

More specifically, in accordance with the present invention, there is provided a twin compressor comprising a motor assembly, a first compressor mounted to a first end portion of the motor assembly, a second compressor mounted to a second end portion of the motor assembly, the motor assembly being located between the first and the second compressors, wherein the first and said second compressors are centrifugal compressors each comprising a first stage impeller and as second stage impeller, the first and the second stage impeller of each one of the first and second compressors being mounted back to back on an end of a rotor driven by a stator of the motor assembly.

There is further provided a twin centrifugal compressor comprising a high-speed electric motor assembly comprising a brushless DC permanent magnet stator and a rotor; a first centrifugal compressor mounted to a first end of the rotor; and a second centrifugal compressor mounted to a second end of the rotor; wherein the first and the second centrifugal compressors each comprising at least one stage impeller the at least one stage impeller of the first compressor being mounted on the first end of the motor shaft driven by the brushless DC permanent magnet stator of the motor assembly, and the at least one stage impeller of the second compressor being mounted on the second end thereof.

There is further provided a modular refrigeration system comprising a first compressor mounted to a first end of a rotor of a high-speed electric motor assembly; and a second compressor mounted to a second end of the rotor; wherein the first and the second compressors are centrifugal compressors each comprising a first stage impeller and a second stage impeller, s the first stage impeller and the second stage impeller of the first compressor being mounted on the first end of the rotor shaft driven by a brushless DC permanent magnet stator of the motor assembly and said first stage impeller and the second stage impeller of the second compressor being mounted on the second end of the rotor shaft driven by the brushless DC permanent magnet stator.

Other objects, advantages and features of the present invention will become more apparent upon reading of the following non-restrictive description of embodiments thereof, given by way of example only with reference to the accompanying drawings.

DESCRIPTION OF THE EMBODIMENT

Generally stated, the present invention provides a centrifugal compressor comprising compressors mounted on a single common motor, thereby sharing a single drive, in such a way that the thrust at high RPM is balanced by using electromagnetic bearings.

Figure 1:
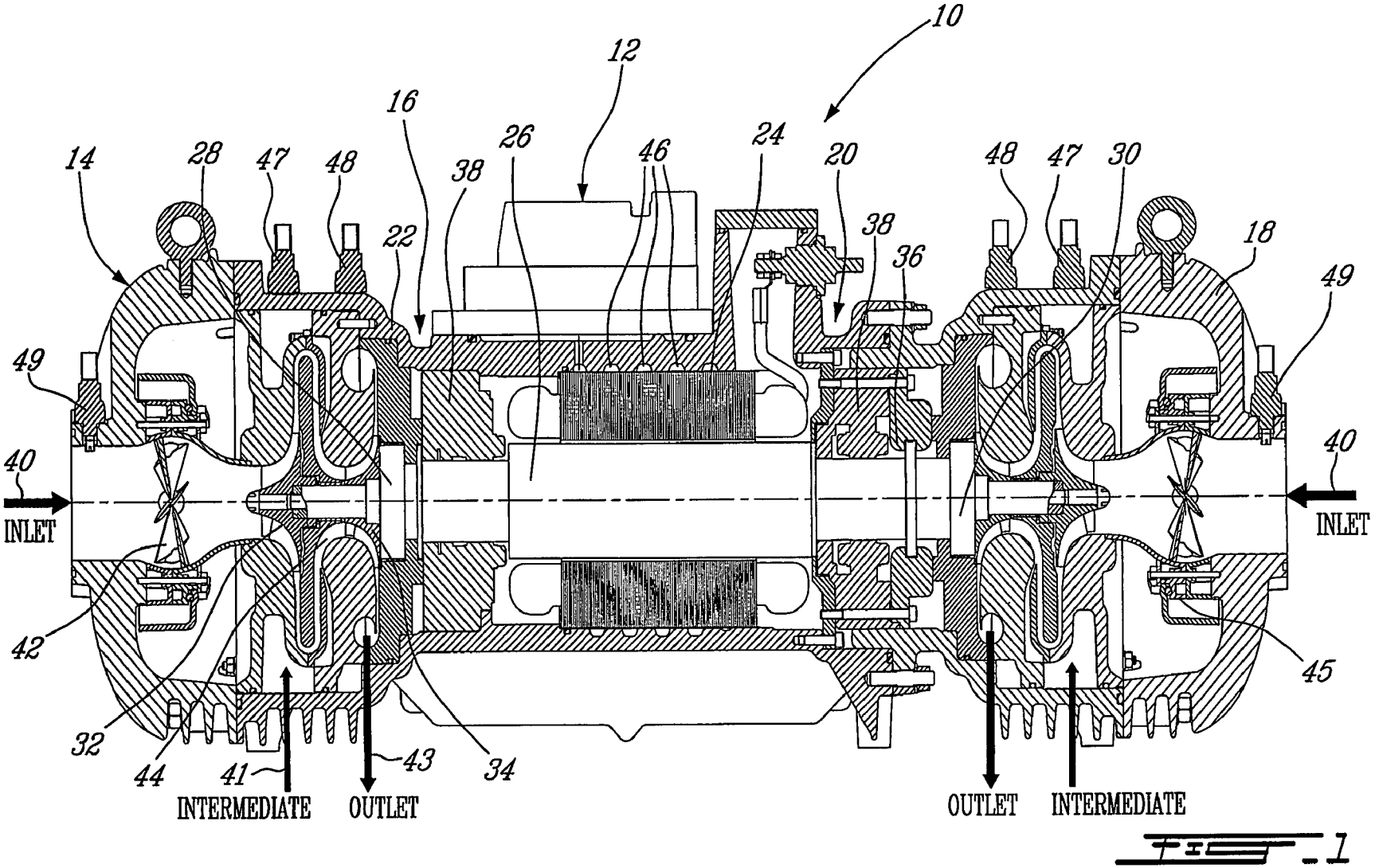
FIG. 1 is a sectional side elevational view of a centrifugal compressor according to the present invention.

More precisely, as illustrated in FIG. 1 of the appended drawings, a twin centrifugal compressor 10 in accordance with the present invention comprises an electric motor assembly 12, a first centrifugal compressor 14, and a second centrifugal compressor 18 within housing 22.

The first centrifugal compressor 14 is mounted to a first end portion 16 of the electric motor assembly 12 and the second centrifugal compressor 18 is mounted to a second end portion 20 of the electric motor assembly 12 in such a way that the electric motor assembly 12 is generally centrally located between the first and second centrifugal compressors 14 and 18.

The electric motor assembly 12 may be a high-speed electric motor assembly comprising a brushless DC permanent magnet motor stator 24 and a rotor 26. The rotor 26 has a first end 28, in the first end portion 16 of the electric motor assembly 12, to which the first compressor 14 is mounted, and a second end 30, in the second end portion 20 of the electric motor assembly 12, to which the second compressor 18 is mounted.

The rotor 26 is formed of segments of a rare earth material as known in the art, such as neodymium iron boride for example, providing extremely high electrical efficiency and permitting very high speeds. The electric motor assembly 12 is capable of speeds of up to 150,000 rpm and more. Such high rotational speeds allow a high efficiency of the compressor 10 over a range of compressor loads.

The housing 22 is formed of a material that is stable and resistant to high temperature. It may be formed of an injection molded synthetic plastic material, or of a material that is glass-filled for strength, or machined, or cast metal, such as aluminum or steel for example.

For concision purposes and since the first and second compressors 14 and 18 are essentially identical, and may be either mirrored versions of each other or each profiled in a way to act as a multiple staged compressor, depending on specific applications, only the first compressor 14 will be described in detail hereinbelow.

The compressor 14 is typically a centrifugal compressor comprising two compressor stages mounted back-to-back namely a first stage impeller 32 and a second stage impeller 34. Both stage impellers 32 and 34 are mounted on the first end 28 of the rotor shaft 26 driven by the brushless DC permanent magnet stator 24 of the electric motor assembly 12.

Axial and radial electromagnetic beatings 36 and 38 are provided to counteract axial and radial loading on the rotor shaft 26. The radial magnetic bearings may be of the passive/active type utilizing permanent magnet technology, or of the active-only type. In both cases, a control circuitry therefor may be provided into the compressor. Such control circuitry, which is believed to be well known in the art and will therefore not be described in detail herein, may take the form of three-dimensional printed circuit boards formed integral with the housing 22, combined with sensors located on fixed and rotational parts of the bearings. Such control circuitry determines a location of the rotational bearing part relative to the fixed part at a given time and yields error signals allowing making magnetic adjustments to correct any deviation at any given angular position.

A compressor control system (not shown) may be further provided that includes a power supply means to supply electrical power to the active magnetic bearings in the event that a system power outage occurs during operation of the compressor 10. Such power supply means may involve the use of the electric motor assembly 12 as a generator if power supply to the motor is cut, or the use of the bearings to generate a self-sustaining power supply. Ceramic touch down bearings may be provided to support bearing loads when the rotor shaft 26 is stationary due to a loss of electrical power to the motor 12 and magnetic bearings 36, 38.

It will be understood that the two-stage compressor of the present invention enables axial loading on the motor shaft 26 to be substantially balanced thus strongly reducing the need of an axial magnetic bearing.

A gas inlet chamber 40 houses adjustable guide vanes 42 that throttle a gas flow to the first stage impeller 32. In a low load condition, the guide vanes 42 are moved to reduce the gas flow, whereas in a high load condition the guide vanes 42 are opened to allow an increase in the gas flow to the first stage compressor 14.

In an alternative embodiment, the motor speed may be varied to match a required capacity of the compressor and the guide vanes 42 are adjusted in conditions where there is a risk of surge or choke or in conditions where the load on the impellers at each end of the compressor do no equally match one another.

In the embodiment illustrated in FIG. 1, a number of guide vanes 42 extend radially inwardly from the inlet end 40 of the housing 22, each vane being rotatable about a radially extending axis. Each vane has a cam, and a finger extending from the cam, which engages in a corresponding slot in a control ring 45 carried by the housing 22, so that rotation of the control ring 45 causes movement of the cams about their respective axis, thus causing rotation of the guide vanes 42. The control ring 45 may be rotated by a linear motor or the like (not shown).

A refrigerant gas, after passing the first stage impeller 32 passes through a gas passage 44 to an inlet of the second stage compressor 34. The second gas inlet may or may not be provided with guide vanes, depending an the compressor size and the degree of control that is necessary.

The stator 24 defines, with the housing 22, a number of motor cooling channels 46 where either a liquid refrigerant led from a refrigerant circuit or a gaseous refrigerant bypassing either the second stage or both stages of the compressor may flow. By using refrigerant as a cooling medium, the motor heat can be dissipated in a condenser of the refrigeration circuit, thereby providing an efficient heat transfer system.

The two-stage compressor of his invention is provided with pressure transducers 47, 48 and 49 in the inlet 40, in an intermediate passage 41 and in an outlet passage 43 respectively. The pressure transducers 47, 48 and 49 are used to control the speed of the motor through a control circuit using a control logic so that a tip speed pressure of the second stage impeller 34 is only slightly above a condensing pressure in a condenser of the assembly and the operating point of the compressor is maintained above a surge point.

The pressure transducer 49 in the inlet chamber 40 allows a control of the guide vanes 42 to thereby control an amount of gas passing through the compressor and to provide a constant suction pressure according to the load. Indeed, as the load reduces, the speed of the compressor slows down or the guide vane 42 closes off to reduce the flow rate through the compressor, depending on the load and operating conditions. In some cases the guide vanes 42 will only close off when the compressor speed is reduced to a point where the compressor is about to surge and further load reduction is handled by the guide vanes 42. In some cases, the guide vanes 42 may be required to close when the compressors are not evenly matched.

People in the art will appreciate that the present invention provides compressors of various capacities ranging from, for example, families of 5 ton to 20 Ton, 60 to 200 Ton and 200 to 1,000 Ton, wherein the compressors are multiple-stage or multiple-compressors compressors using a number of parts shared between all compressors. For example, the housing 22, bearings 36, 38 and the electric motor assembly 12 may be common throughout each of the sets of frame sizes and the control platform for the bearings, motor inverter, compressor controller, soft starter, overall system control and multiple compressor control can be common to all compressors. Therefore, the only changes that need to be made to vary the capacities are to the motor size and power and to the design of impellers, guide vanes and the like.

It is to be noted that the housing, motor cooling ducting, labyrinths and other internal structural components may be injection molded using the General Electric "ULTEMP" plastics material or other glass filled composite materials that have extreme rigidity, or aluminum casting, which all are impervious to chemical attack, are electric nonconductors and are highly heat resistant.

People in the art will appreciate that such a twin compressor 10 as described herein above may be a twin refrigeration compressor.

FIGS. 2 to 5 illustrate a number of examples of systems incorporating the centrifugal compressor of the present invention.

Figure 2:
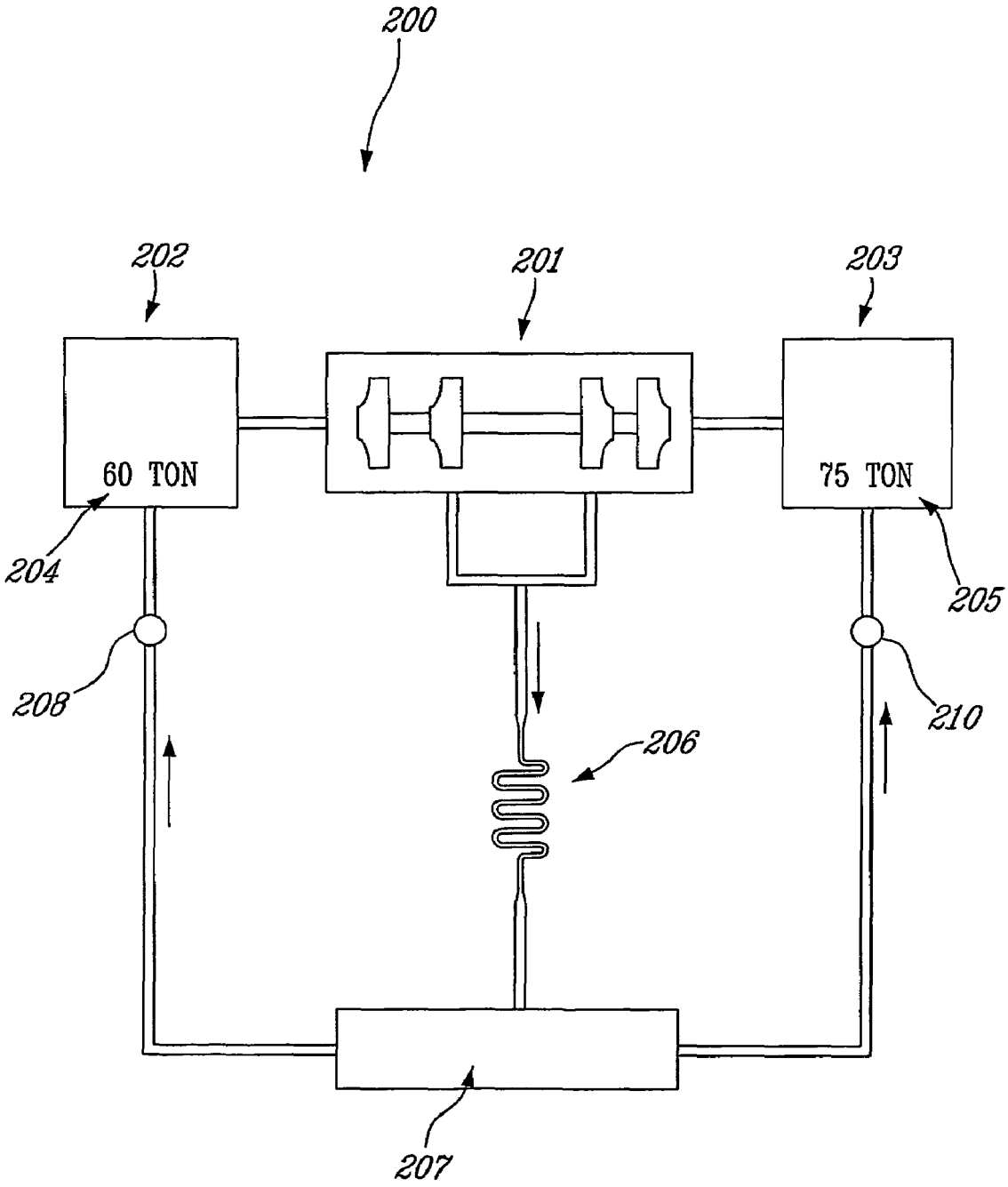
FIG. 2 is a schematic diagram of a system including the centrifugal compressor of FIG. 1 according to an embodiment of the present intention.

In the system 200 of FIG. 2, a twin centrifugal compressor 201 according to the present invention is used in combination with two separate dual evaporators 202 and 203 operating at two different sets of conditions 204 and 205, for example; a condenser 206; and a liquid receiver 207. The system 200 thereby provides a multiple zoned system allowing varying load conditions and operating suction temperatures. The speed of the compressors of the twin centrifugal compressor 201 may be adjusted to match a maximum demand. Guide vanes 208, 210 may control the capacity of the system 200 with the minimum load.

Figure 3:
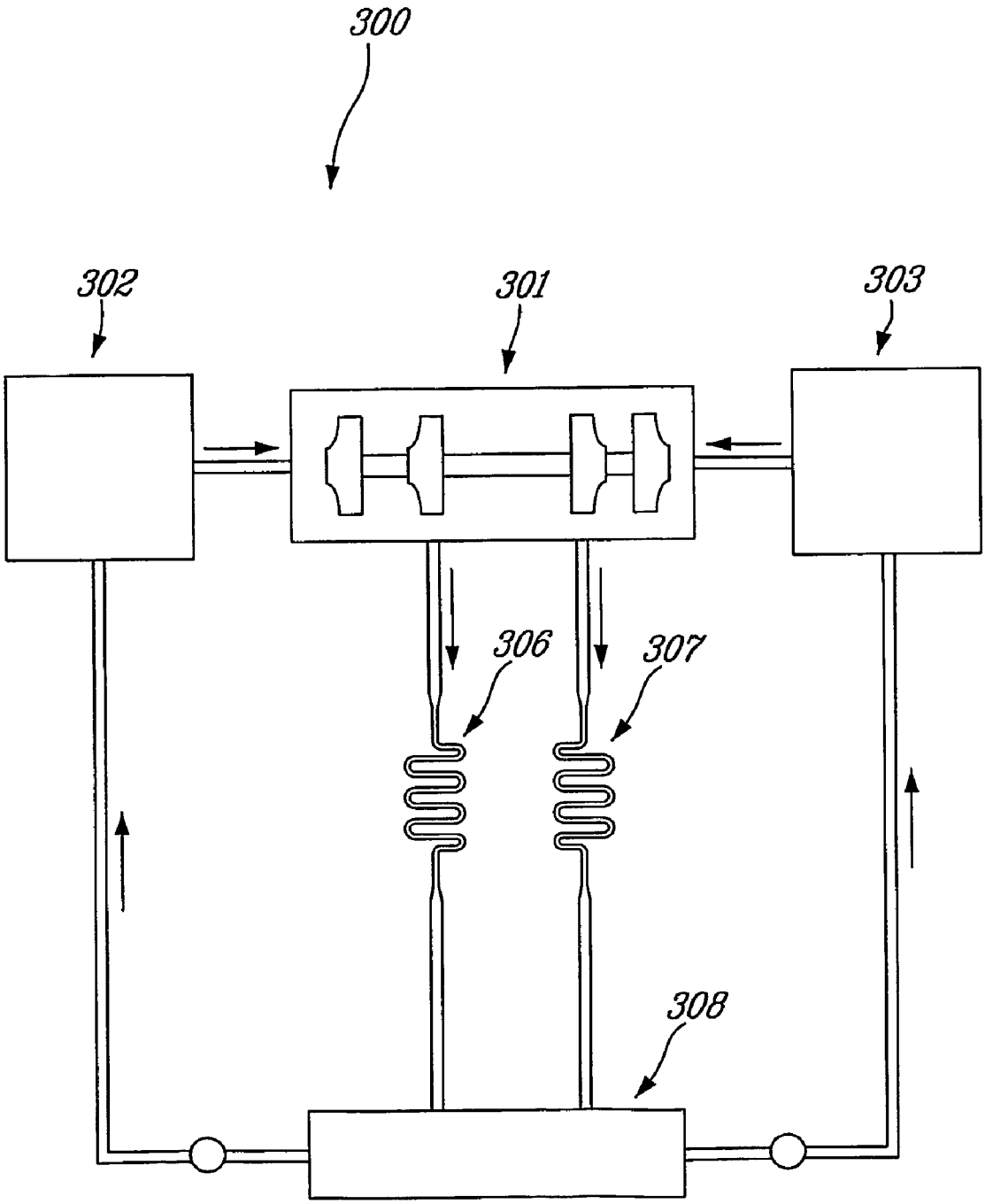
FIG. 3 is a schematic diagram of a system including the centrifugal compressor of FIG. 1 to a further embodiment of the present invention.

FIG. 3 shows still a further system 300 comprising a twin centrifugal compressor according to the present invention. The twin centrifugal compressor 301 is used to pump gas into two separate condensers 306 and 307, and from there to two separate evaporators 302 and 303, which are fed from one common liquid line 308. Such a system 300 allows for enhanced installation and operating flexibility and overall energy savings compared with an equivalent system with a single circuit.

Figure 4:
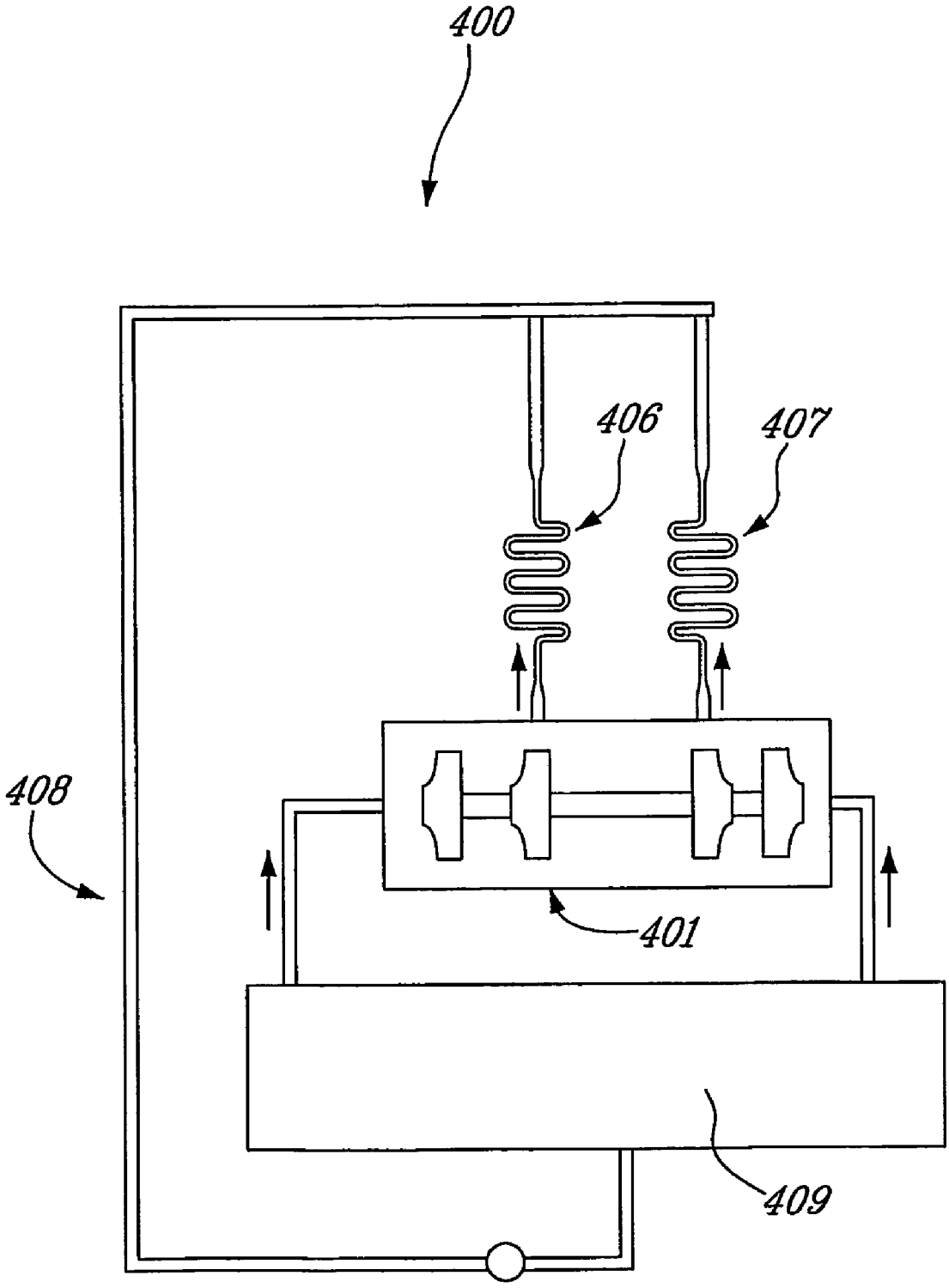
FIG. 4 is a schematic diagram of a system including the centrifugal compressor of FIG. 1 according to another embodiment of the present invention.

In the system 400 of FIG. 4, a twin centrifugal compressor according to the present invention pumps a gas into two separate condensers 406 and 407, and from there to an evaporator 409 through a liquid line 408. Such a system 400 allows for enhanced manufacturing and operating flexibility, as well as for overall energy savings in comparison with equivalent systems having as single condenser.

Figure 5:
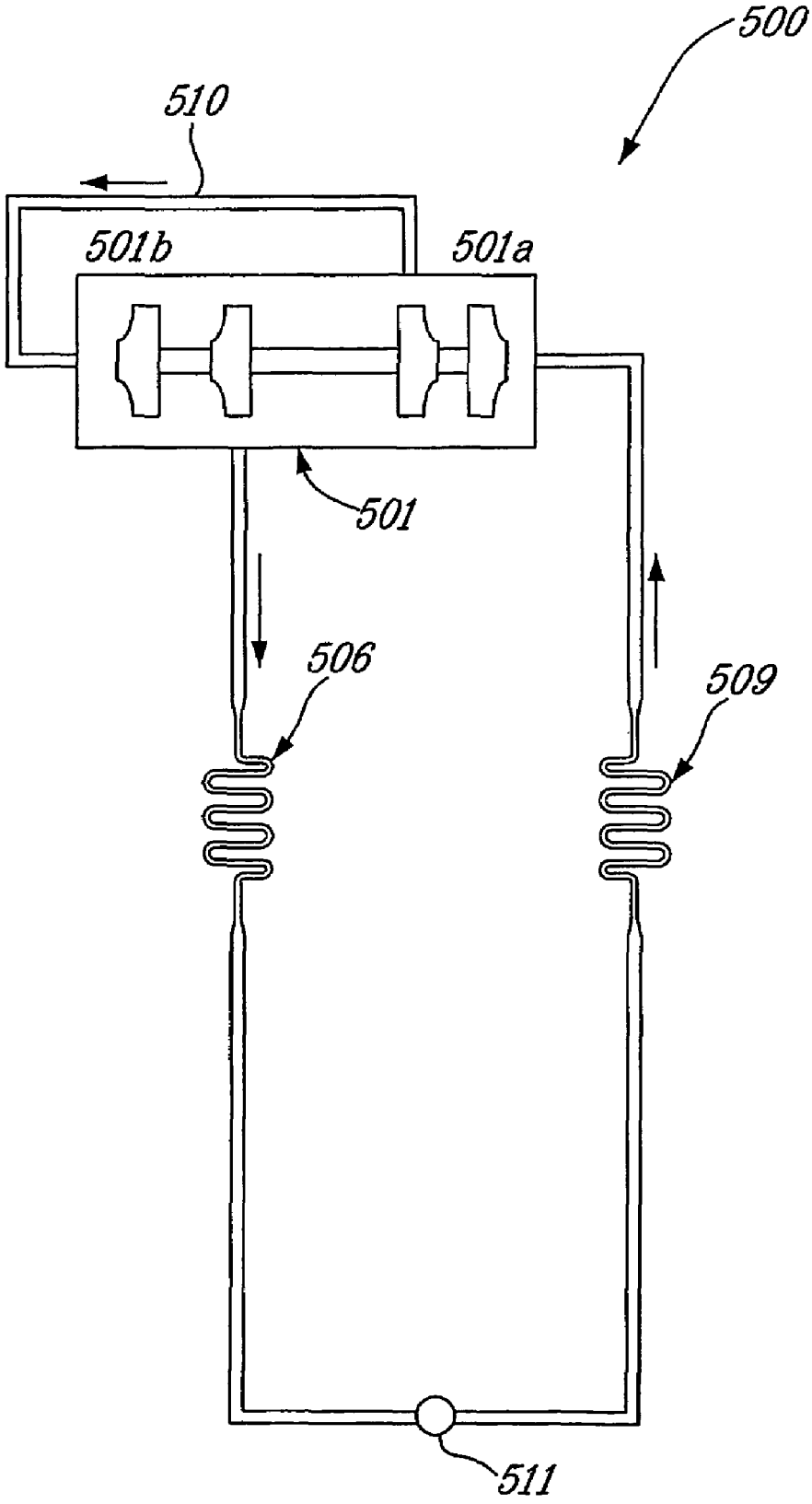
FIG. 5 is a schematic diagram of a system including the centrifugal compressor of FIG. 1 according to still another embodiment of the present invention.

FIG. 5 illustrates a system 500 comprising a multiple stage compressor 501 according to the present invention, in such a way that a first set of stages 501*a* thereof pumps gas directly into a second set of stages 501*b* thereof through a connecting tube 510. From there, the gas is pumped into a condenser 506 and from there is fed through an expansion device 511 into an evaporator 509, before being fed back to the first set of stages 501*a* of the compressor 501, thus completing the loop. People in the art will appreciate that such a system 500 allows balancing an axial pressure, while normal forces occurring in a single ended system tend to become large, especially when foil or magnetic types of bearings are used.

From the foregoing, it is apparent that the compressor of the present invention may be used in a modular refrigeration system wherein a plurality of substantially identical modular refrigeration units are assembled together to form the air conditioning system, and wherein a control logic is provided that allows starting or stopping additional compressors according to detected load conditions.

Furthermore, the compressor of the present invention, by using oilless bearing technology, such as magnetic or foil bearings, may be used with advanced refrigerants such as R134A refrigerant. Such an oil-less bearing technology also permits very high rotational speeds, resulting in substantially improved operating efficiencies of the compressor as compared with standard centrifugal compressors.

Moreover, the compressor of the present invention have a structure provided with the necessary strength for longevity while enabling the compressor to be manufactured of a size substantially less than that of compressors of equivalent capacity. Indeed people in the art will appreciate that a compressor in accordance with the present invention may be less than one half the size and one-third the weight of an equivalent known compressor.

Therefore, as will be apparent to people skilled in the art, the compressor of the present invention is a compact and effective compressor most useful for domestic applications and commercial for example, while simultaneously enabling high speed and a reliable control system, by using two separate compressors mounted on a single common motor thereby sharing a single drive. It should be noted that balancing of the thrust at high rpm is performed by using back to back impellers, thus greatly reducing the load on the axial electromagnetic bearings. Finally, though meeting the requirements for high operating conditions, the compressor of the present invention results in reduced manufacturing costs.

Although the present invention has been described hereinabove by way of preferred embodiments thereof, it can be modified, without departing from the teachings and teachings of the subject invention as defined in the appended claims.

What is claimed is:

1. A twin compressor comprising a motor assembly, a first compressor mounted to a first end portion of said motor assembly, a second compressor mounted to a second end portion of said motor assembly, said motor assembly being located between said first and said second compressors, wherein said first and said second compressors are mirrored versions of each other and are centrifugal compressors each comprising a first stage impeller and a second stage impeller, said first and said second stage impellers of said first and second compressors being mounted back to back on an end of a rotor driven by a stator of said motor assembly.

2. A twin centrifugal compressor comprising:

a high-speed electric motor assembly comprising a brushless DC permanent magnet stator and a rotor;

a first centrifugal compressor mounted to a first end of said rotor; and a second centrifugal compressor mounted to a second end of said rotor;

wherein said first and said second centrifugal compressors each comprise at least one stage impeller, said at least one stage impeller of said first compressor being mounted on a first end of a rotor shaft driven by the brushless DC permanent magnet stator, and said at least one stage impeller of a second compressor being mounted on a second end thereof; and wherein said electric motor is capable of speeds greater than 150,000 rpm.

3. A twin centrifugal compressor comprising:

a high-speed electric motor assembly comprising a brushless DC permanent magnet stator and a rotor;

a first centrifugal compressor mounted to a first end of said rotor; and a second centrifugal compressor mounted to a second end of said rotor;

wherein said first and said second centrifugal compressors each comprise at least one stage impeller, said at least one stage impeller of said first compressor being mounted on a first end of a rotor shaft driven by the brushless DC permanent magnet stator, and said at least one stage impeller of a second compressor being mounted on a second end thereof;

further comprising radial and axial non-lubricated bearings to counteract axial loading on the rotor shaft; and wherein said non-lubricated bearings are electromagnetic bearings consisting of a passive/active type and an active-only type.

4. The twin compressor according to claim 3, further comprising a control circuitry.

5. The twin compressor according to claim 4, wherein said control circuitry comprises a three-dimensional printed circuit and sensors located on fixed and rotational parts of said bearings.

6. The twin compressor according to any of claims 4 and 5, wherein said control circuitry comprises a power supply means.

7. A use of a twin compressor comprising a motor assembly, a first compressor mounted to a first end portion of said motor assembly, a second compressor mounted to a second end portion of said motor assembly, said motor assembly being located between said first and said second compressors, wherein said first and said second compressors are centrifugal compressors each comprising a first stage impeller and a second stage impeller, said first and said second stage impellers of said first and second compressors being mounted back to back on an end of a rotor driven by a stator of said motor assembly, the use of which is in combination with dual evaporators operating at different sets of conditions, a condenser, and a liquid receiver to allow varying load conditions and operating suction temperatures.

8. A use of a twin compressor comprising a motor assembly, a first compressor mounted to a first end portion of said motor assembly, a second compressor mounted to a second end portion of said motor assembly, said motor assembly being located between said first and said second compressors, wherein said first and said second compressors are centrifugal compressors each comprising a first stage impeller and a second stage impeller, said first and said second stage impellers of said first and second compressors being mounted back to back on an end of a rotor driven by a stator of said motor assembly, the use of which is to pump gas into separate condensers, and from there to separate evaporators, which are fed from one common liquid line.

9. A use of a twin compressor comprising a motor assembly, a first compressor mounted to a first end portion of said motor assembly, a second compressor mounted to a second end portion of said motor assembly, said motor assembly being located between said first and said second compressors, wherein said first and said second compressors are centrifugal compressors each comprising a first stage impeller and a second stage impeller, said first and said second stage impellers of said first and second compressors being mounted back to back on an end of a rotor driven by a stator of said motor assembly, the use of which is to pump a gas into separate condensers, and from there to an evaporator through a liquid line.

10. A twin centrifugal compressor comprising:

a high-speed electric motor assembly comprising a brushless DC permanent magnet stator and a rotor;

a first centrifugal compressor mounted to a first end of said rotor; and a second centrifugal compressor mounted to a second end of said rotor;

wherein said first and said second centrifugal compressors each comprise at least one stage impeller, said at least one stage impeller of said first compressor being mounted on a first end of a rotor shaft driven by the brushless DC permanent magnet stator, and said at least one stage impeller of a second compressor being mounted on a second end thereof; and wherein a first set of stages thereof pumps gas directly into a second set of stages thereof through a connecting tube and from there into a condenser to feed the gas into an evaporator, before feeding back the first set of stages in a loop.

11. A modular refrigeration system comprising a first compressor mounted to a first end of a rotor of a high-speed electric motor assembly; and a second compressor mounted to a second end of said rotor; wherein said first and said second compressors are centrifugal compressors each comprising a first stage impeller and a second stage impeller, said first stage impeller and said second stage impeller of said first compressor being mounted on a first end of a rotor shaft driven by a brushless DC permanent magnet stator of said motor assembly and said first stage impeller and said second stage impeller of said second compressor being mounted on a second end of the rotor shaft driven by said brushless DC permanent magnet stator and further comprising a control logic to start and stop additional compressors according to detected load conditions.

* * * * *